US012796789B2

(12) United States Patent
Weitman

(10) Patent No.: US 12,796,789 B2
(45) Date of Patent: Nov. 17, 2026

(54) GEMSTONE CUT

(71) Applicant: Zev Wolf Weitman, Brooklyn, NY (US)

(72) Inventor: Zev Wolf Weitman, Brooklyn, NY (US)

( * ) Notice: Subject to any disclaimer, the term of this patent is extended or adjusted under 35 U.S.C. 154(b) by 116 days.

(21) Appl. No.: 18/036,559

(22) PCT Filed: Nov. 11, 2021

(86) PCT No.: PCT/US2021/072347
§ 371 (c)(1),
(2) Date: May 11, 2023

(87) PCT Pub. No.: WO2022/104351
PCT Pub. Date: May 19, 2022

(65) Prior Publication Data

US 2024/0008603 A1 Jan. 11, 2024

Related U.S. Application Data

(63) Continuation-in-part of application No. 29/758,255, filed on Nov. 13, 2020, now Pat. No. Des. 997,773.

(60) Provisional application No. 63/113,324, filed on Nov. 13, 2020.

(51) Int. Cl.
*A44C 17/00* (2006.01)

(52) U.S. Cl.
CPC ..... *A44C 17/005* (2013.01)

(58) Field of Classification Search
CPC ..... A44C 17/005; A44C 17/00; A44C 17/001; A44C 17/002; A44C 17/02; A44C 17/04; A44C 27/00
USPC ..... 63/32; D11/89, 90
See application file for complete search history.

(56) References Cited

U.S. PATENT DOCUMENTS

| | | | | |
|---|---|---|---|---|
| D382,506 | S * | 8/1997 | Cohen | D11/90 |
| D439,542 | S * | 3/2001 | Turner | D11/89 |
| 6,604,382 | B2 * | 8/2003 | Shuto | B28D 5/00 D11/89 |
| 6,698,239 | B2 * | 3/2004 | Wueste | A44C 17/001 D11/89 |
| D488,740 | S * | 4/2004 | Freund | D11/90 |
| 7,146,827 | B2 * | 12/2006 | Mardkha | A44C 17/001 D11/89 |
| D545,237 | S * | 6/2007 | Weitman | D11/90 |
| D545,718 | S * | 7/2007 | Weitman | D11/90 |

(Continued)

*Primary Examiner* — Jason W San
*Assistant Examiner* — Anna S Rashid
(74) *Attorney, Agent, or Firm* — Amster, Rothstein & Ebenstein LLP

(57) ABSTRACT

A gemstone cut into a round or modified round shape have a total of 81 facets. The gemstone includes a crown and a bottom separated by a girdle. The crown includes a table surrounded by 16 star facets. The 16 star facets are surrounded by 8 primary bezel facets, and 8 secondary bezel facets. The 8 primary and secondary bezel facets are surrounded by 16 primary upper girdle facets such that the crown has a total of 48 facets surrounding the table. A bottom of the gemstone has a culet surrounded by 8 primary and 8 secondary pavilion facets. The 8 primary and secondary pavilion facets are surrounded by 16 lower girdle facets therebetween. The bottom has a total of 32 facets surrounding the culet. Including the table this gemstone may have a total of 81 facets which may be surrounded by the girdle.

27 Claims, 10 Drawing Sheets

(56) References Cited

U.S. PATENT DOCUMENTS

D565,994 S * 4/2008 Weitman ..... D11/90
D566,613 S * 4/2008 Weitman ..... D11/90
D568,777 S * 5/2008 Weitman ..... D11/90
D570,726 S * 6/2008 Weitman ..... D11/90
D592,992 S * 5/2009 Weitman ..... D11/90
D616,785 S * 6/2010 Slowinski ..... D11/90
D638,740 S * 5/2011 Weitman ..... D11/90
8,844,319 B2 * 9/2014 Weingarten ..... A44C 17/001 D11/89
9,311,435 B2 * 4/2016 Holloway ..... G06F 30/20
D769,769 S * 10/2016 Hasenfeld ..... D11/90
D839,771 S * 2/2019 Rydlewicz ..... D11/90
10,376,026 B2 * 8/2019 Zhang ..... A44C 17/001
11,452,346 B2 * 9/2022 Loinger ..... A44C 17/001
D992,453 S * 7/2023 Kwiat ..... D11/90
D997,773 S * 9/2023 Weitman ..... D11/90
D1,015,927 S * 2/2024 Mehta ..... D11/90
D1,025,821 S * 5/2024 Weitman ..... D11/90
D1,047,754 S * 10/2024 Paikin ..... D11/90
2002/0116948 A1 * 8/2002 Steinberg ..... A44C 17/04 63/28
2002/0170315 A1 * 11/2002 Mardkha ..... A44C 17/001 63/32
2003/0192346 A1 * 10/2003 Samuels ..... A44C 17/001 63/32
2006/0032271 A1 * 2/2006 Thapar ..... A44C 17/04 63/32
2007/0113586 A1 * 5/2007 Rydlewicz ..... A44C 17/001 63/32
2008/0034793 A1 * 2/2008 Weitman ..... A44C 17/001 63/32
2009/0178438 A1 * 7/2009 Rydlewicz ..... A44C 17/001 63/32
2011/0302960 A1 * 12/2011 Weingarten ..... A44C 17/001 63/32
2012/0180525 A1 * 7/2012 Weingarten ..... A44C 17/001 63/32
2013/0042648 A1 * 2/2013 Humbert, Jr. ..... A44C 17/001 63/32
2014/0116088 A1 * 5/2014 Weitman ..... A44C 17/001 63/32
2016/0213105 A1 * 7/2016 Weitman ..... A44C 17/001
2017/0071299 A1 * 3/2017 Shah ..... A44C 17/00
2017/0181511 A1 * 6/2017 Weitman ..... A44C 17/001
2017/0202319 A1 * 7/2017 Koganei ..... A44C 17/001
2019/0274399 A1 * 9/2019 Tomasik ..... A44C 17/00
2019/0373990 A1 * 12/2019 Lumma ..... A44C 17/04
2021/0219676 A1 * 7/2021 Paikin ..... A44C 17/001
2021/0361040 A1 * 11/2021 Paikin ..... A44C 17/001
2022/0031029 A1 * 2/2022 Tomasik ..... A44C 17/001
2024/0008603 A1 * 1/2024 Weitman ..... A44C 17/005

* cited by examiner

GEMSTONE CUT

CROSS REFERENCE TO RELATED APPLICATIONS

This patent application claims the benefit under 35 U.S.C. § 371 to international application No. PCT/US2021/072347, filed on Nov. 11, 2021, which claims the benefit of U.S. Provisional Application Ser. No. 63/113,324, filed Nov. 13, 2020, and is a continuation-in-part of U.S. Design application Ser. No. 29/758,255, filed Nov. 13, 2020, the contents of which are incorporated by reference herein in their entireties.

FIELD OF INVENTION

The present invention relates to gemstones, and more particularly to new facet arrangements for gemstones and a method to cut the same.

BACKGROUND OF THE INVENTION

U.S. Pat. No. 8,297,075 (hereinafter "075 patent") discloses various embodiments of a cut gemstone and methods of cutting a gemstone, the content of which is incorporated by reference in its entirety. In particular, the '075 patent discloses basic cutting techniques from a rough round stone with a six or eight blocked foundation into a finished round stone which, in one embodiment, has a total of 161 facets on the finished stone having a double table line. In a second embodiment, a total of 177 facets are cut on the stone with a triple table line. In a third embodiment, a total of 194 facets are cut on the stone with the triple table line combined with a triple girdle line. Optionally, a culet facet can also be provided. It is well-known that the greater angle degrees that a second facet is "cut" away from an adjacent first facet, the more pronounced (or stronger) the line (rib line or table line) therebetween becomes. Conversely, the fewer angle degrees the second facet is "cut" away from the first facet, the less pronounced (or weaker) the line therebetween becomes. The number of facets, their arrangement, size and shape, as well as angles with respect to each other, are primary factors that contribute to the overall enhancements in a gemstone.

Diamonds can be described as having a particular brilliance, which is relative to "cut grade", and how facets are arranged, and the angular relation between those top and bottom facets (pitching and catching the light), enhancing the gemstone arrangement to optically perform while interacting with light sources surrounding it. Scintillation or "sparkle", is the reflection of a light source off the surface of a gemstone's facets, interacting with a viewer's eye relative to the angle of viewing the gemstone. The alternation in degrees between angles of facets adjacent to each other, enhances the ability of light to run across and reflect off the gemstones surface at a wider array of positions. Light dispersion, is a term describing the refraction of white light into its spectrum of wavelengths in color, from facets refracting light rather than receiving or reflecting it.

A trade journal from the Gemological Institute of America, entitled "Gem News International" (Gems and Gemology, Vol. 46, No. 2, pp. 147-162; Published Summer 2010) discloses a study on a gemstone with small uneven steep triangular crown facets near the girdle edge that are tilted to provide a direct light path through the stone, and "leak" light, as they appear dark, which creates a scalloped appearance when viewed face-up. In fact, the steep girdle facets do not actually "leak" light. Rather, from the perspective of a viewer the appearance from the top view of the crown appears to be a scalloped edge around the girdle is because the girdle facets do not receive light, and thus don't appear to the viewer because of their steep angle with respect to the table and adjacent bezel facets.

Although the embodiments described and shown in the '075 patent have great appeal, a significant number of facets must be calculated and made in order to achieve the desired finished product. A diamond is the hardest known gemstone, however most have imperfections. Each additional cut that has to be made subjects the gemstone to risk in production, and creates an overall complex performance in facet arrangement for the viewer, as well as a gemstone with weak lines. Accordingly, there is a need to improve upon the facets referenced in the '075 patent the Gems and Gemology 2010 study. Additionally, there is a further need in the art to simplify the prior art gemstone cut arrangements, while enhancing the gemstones features, appearance, performance and appeal.

SUMMARY OF THE INVENTION

The disadvantages heretofore associated with the prior art are overcome by the present gemstone embodiments in which novel facet arrangements are provided with simplified cuts, larger facet sizes as compared to the prior art, and enhanced gemstones features, appearance, performance and appeal.

Advantages herein and notable improvements for industry and consumer alike include greater weight-ratio retention, simplification of facet arrangement on the top and bottom of stone, which allow for greater size of facets and their relation in angles between crown and bottom, as well as enhancing brilliance/light performance. Greater alternation in angle degrees between adjacent facets helps sharpen the lines on gemstone, and enhance scintillation/sparkle and the inner texture of gemstone. Greater size for triangular crown facets near edge of girdle referenced in 'gems and gemology 2010, as well as better angle for their performance as direct light paths, sharpening the stone immensely, and providing a more scalloped appearance. The extension of the triangular facets from the girdle to the table (round), or from the table to the girdle (modified round), provides the gemstones viewer a perception of a sun (round) or flower (modified round), with outer as well as inner characteristics being displayed when the gemstones interact with light, from subjecting the visual arrangement to ideal facet angles. The two embodiments herein are built upon an identical foundational structure on top and bottom, only differing in the amount of blocking sections (first stage of cutting, foundational facet building) given their respective round (eight sections) or modified round (six sections) shape. The two embodiments share a method of secondary blocking, wherein a secondary section of facets splits the main foundation of the blocked facets set during the primary procedure of cutting the top and bottom of the gemstone. Both sections of primary and secondary top and bottom facets, result in the same shape, are nearly the same size (depending on top or bottom on a six or eight blocking structure), and reach nearly the same distance in surface area of the gemstone. The two embodiments also show relation in their final arrangement after brillianteering, which is the second stage of cutting, where the final facet shapes are formed, and resemble each other on top and bottom of stone alike, with respect to triangular facet size as referenced herein.

In one embodiment, a gemstone comprises a crown portion and a bottom portion separated by a girdle, the crown including a table surrounded by eight primary bezel facets and eight secondary bezel facets adjacent to and alternating between the primary bezel facets, the eight primary and secondary facets extending at an angle from the table in a direction towards the girdle; the primary bezel facets extend downward from the table at a steeper angle into the girdle than the adjacent secondary bezel facets which advance into to the girdle at a lower angle, the sixteen bezel facets all retain the same shape, and nearly the same size; eight pairs of triangular shaped star facets which are defined by the table and angles of adjacent primary and secondary bezel facets, wherein the star facets extend downward from the table towards the girdle approximately 40% of the distance between the table and the girdle; eight pairs of upper girdle facets, wherein each upper girdle facet extends from the girdle towards the table approximately 60% of the distance from the girdle and the table; the bottom portion including a central culet and a central axis that extends through the culet and a center point of the table, the bottom portion further including eight primary pavilions extending downward from the girdle to the culet and eight secondary pavilions adjacent to and alternating between the primary pavilions, the eight secondary pavilions advance further into the girdle than their adjacent primaries, and extend downward from the girdle towards the culet approximately 85% of the distance between the girdle and culet; and eight pairs of lower girdle facets which extend from the girdle towards the culet approximately 70% of the distance between the girdle and the culet.

In one aspect, the eight primary bezel facets are cut in a range of one to two degrees higher than the secondary bezel facets with respect to a girdle plane. In another aspect, the star facets are cut lateral to a respective bezel facet approximately three degrees lower (flatter) with respect to the girdle plane, thereby accentuating a plurality of rib lines therebetween. In a further aspect, the upper girdle facets are approximately three degrees steeper than the adjacent bezel facets with respect to the girdle plane. In yet another aspect, each bottom facet is angled away equally approximately eleven and a quarter degrees to an adjacent facet in a 360-degree radius of a round gemstone.

In another embodiment, a gemstone comprises: a crown and a bottom separated by a girdle, the crown including a table surrounded by six primary bezel facets, six secondary bezel facets alternating there between, wherein the primary bezels advance from the table into the girdle a distance greater than the secondary bezel facets, the primary bezel facets being cut two to three degrees higher than the adjacent secondary bezel facet with respect to a girdle plane; six pairs of triangular shaped stars, wherein the stars extend downward from the table towards the girdle approximately 75% of a distance between the table and the girdle, and are cut away from right and left of their respective bezel facet at approximately three degrees lower of an angle; six pairs of top breaks wherein they extend approximately 25% towards the table, and are determined at approximately fifty-five degrees with respect to the girdle plane; A bottom including six primary pavilions extending from the girdle to the culet; six secondary pavilions adjacent to the six primary pavilions which advance deeper into the girdle than the adjacent primary pavilions, the secondary pavilions extending from the girdle approximately 90% towards the culet and having a width equal to or substantially equal to the adjacent primary pavilions; and six pairs of lower girdle facets which extend from the girdle approximately 70% towards the culet, wherein each bottom facet is equally angled away from its adjacent facet approximately fifteen degrees in a 360-degree radius of its modified round shape.

BRIEF DESCRIPTION OF THE DRAWINGS

The above and other features of the present invention, it's nature and various advantages will be more apparent upon consideration of the following detailed description, taken in conjunction with accompanying drawings in which.

To facilitate understanding of the invention, identical reference numerals have been used, when appropriate, to designate the same or similar elements that are common to the figures.

DETAILED DESCRIPTION OF THE EMBODIMENTS

Figure 1A:
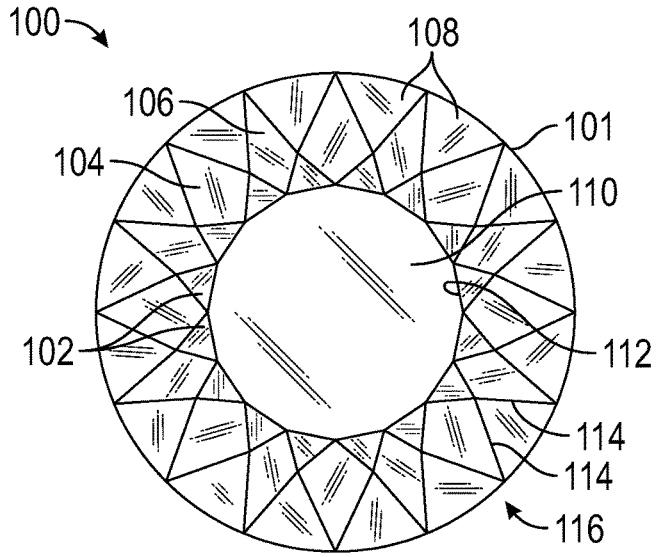
FIGS. 1A-1E depict various views of a first embodiment of a round gemstone cut in accordance with the present invention.
Figure 1B:
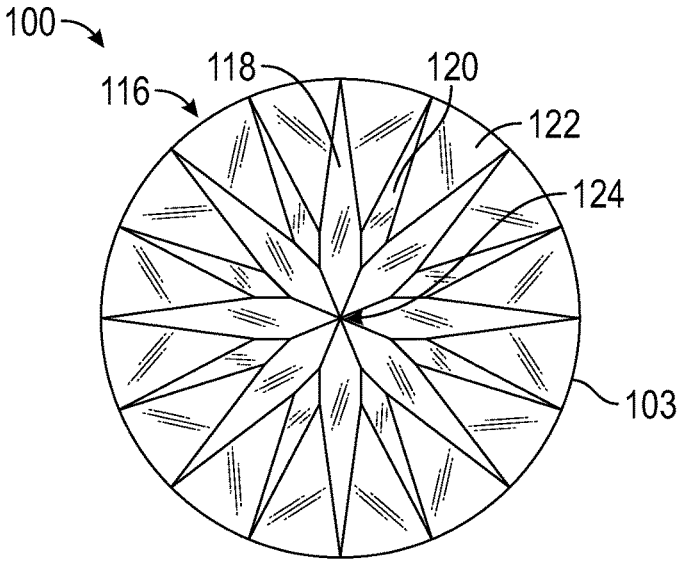
Figure 1C:
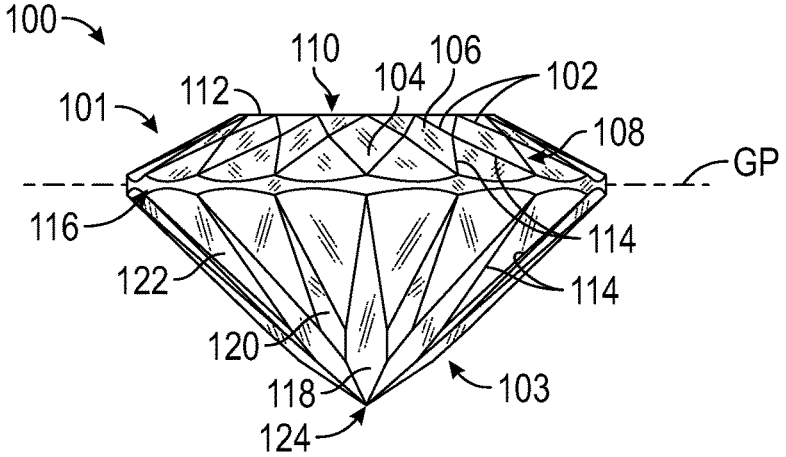

Referring to FIG. 1A-1E, a first embodiment of the gemstone 100 is illustratively shown. The gemstone 100 includes a crown 101, bottom 103 and a girdle 116. The girdle 116 is the area of separation between crown 101 and the bottom 103 of stone, as best seen in FIG. 1C. The crown 101 illustratively includes sixteen star facets 102 (also referred to as eight pairs of star facets), eight primary bezel facets 104, eight secondary bezel facets 106, sixteen upper girdle facets 108 (also referred to as eight pairs of upper girdle facets), and one circular table indicated 110, as shown in FIG. 1A.

The facets on a diamond are intersecting geometric planes forming one line, which occurs at the points of two intersecting facets. If one of those two intersecting facets is the table 110, the line at the intersecting point of those two facets is called the table line 112. Any other line on the diamond, i.e., on the crown 101 or on the bottom 103, is called a rib line 114. FIG. 1A shows the crown of the present invention with sixteen table lines 112, and a plurality of rib lines 114.

FIG. 1B shows a bottom view of the first embodiment of the gemstone 100 with the girdle 116, eight primary pavilion facets 118, eight secondary pavilion facets 120, and sixteen lower girdle facets 122 (also referred to as eight pairs of lower girdle facets), and a culet 124.

Figure 1D:
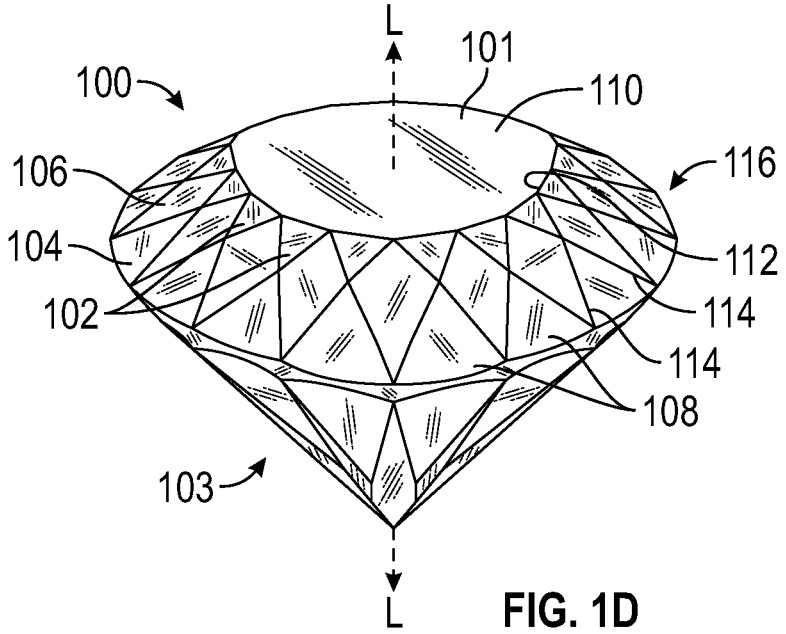
Figure 1E:
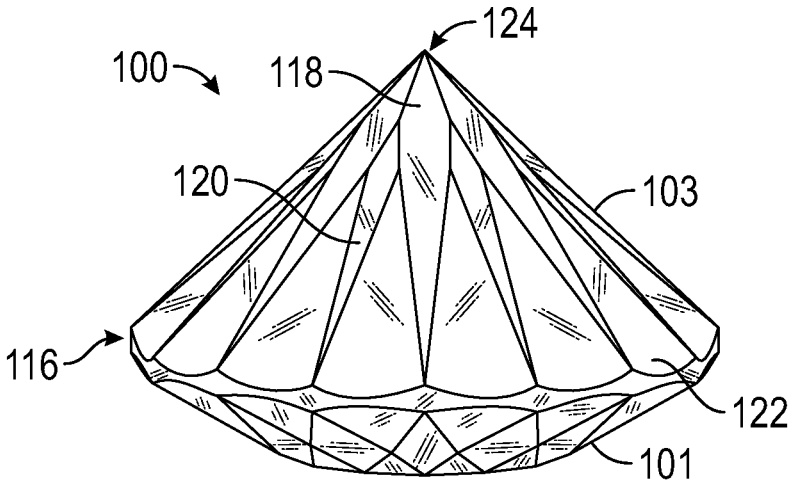

Also shown for sake of better understanding the arrangement of the facets is FIG. 1C, which depicts a side elevation view of the first embodiment of the gemstone 100, and FIGS. 1D and 1E which depict top and bottom perspective views of the first embodiment of the gemstone 100, respectively.

Figure 2A:
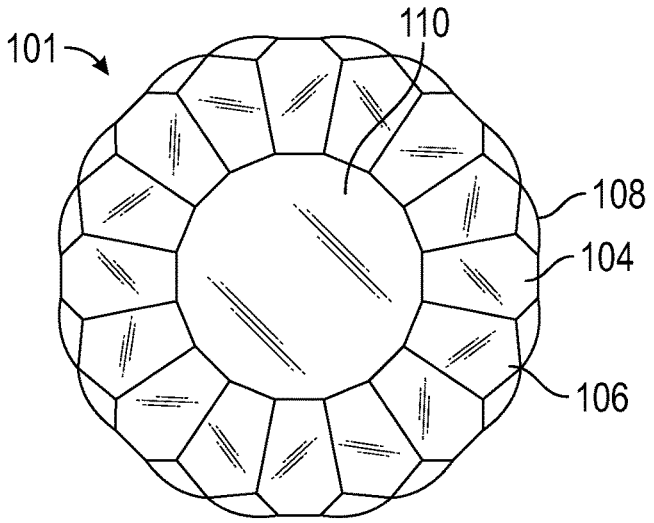
FIGS. 2A-2C depict various top views of cutting stages of a crown portion of the first embodiment of FIGS. 1A-1E from a round blocked crown to the finished crown cut of the gemstone.
Figure 2B:
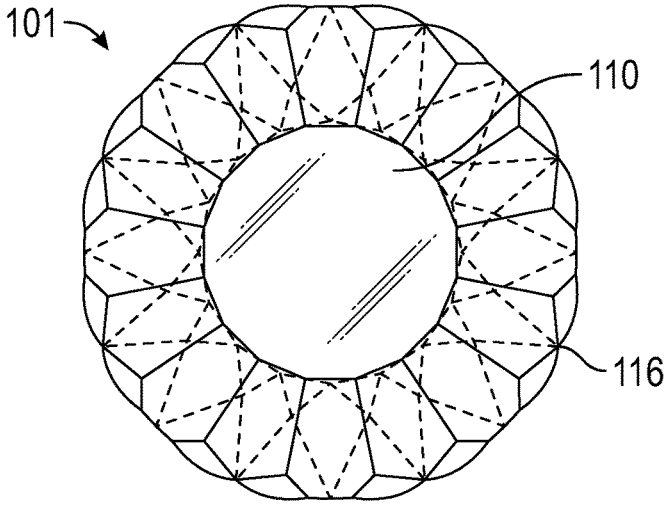
Figure 2C:
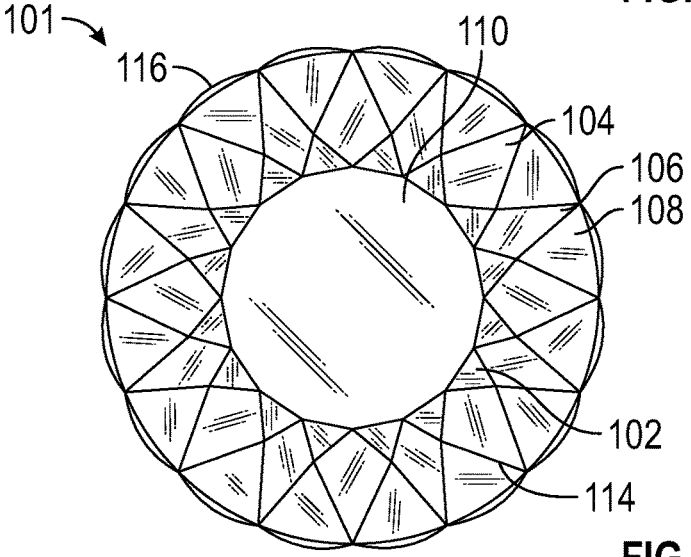

Referring now to FIGS. 2A-2C, top schematic views for cutting the crown 101 of the first embodiment of FIGS. 1A-1E from a rough round stone to the finished crown 101 is shown. In FIG. 2A, the initial formation of the round shape is shown as an eight-count block having eight primary bezels 104, eight secondary bezels 106 and sixteen upper girdle facets 108. In a first step the eight primary bezels facets 104 are cut. In a second step, the crown's 101 secondary blocking procedure is performed in which eight secondary bezels 106 are cut such that they are positioned, i.e., interleaved, adjacently between the eight primary bezel facets as shown, and are approximately the same size as their primaries 104. The primary bezels 104 advance further into the girdle at a steeper angle, than their adjacent secondary bezels 106 which reach the girdle but don't advance as far in being on a lower angle.

Referring to FIG. 2B, the secondary cutting process of brillianteering is illustratively shown. Indicated by broken lines, the sixteen star facets (triangular-shaped facets) 102 are formed. The inception of each of the sixteen star facets 102 along each leg is at the rib line 114 formed between an adjacent pair of a primary bezel 104 and a secondary bezel 106. Each star facet 102 has one side (base) adjacent to and forming a table line 112 with the table 110. Each leg of the triangle star 102 advances down the rib line 114 from the table 110 and form an apex that reaches approximately 40% to the girdle 116.

The sixteen upper girdle facets 108 are also formed between adjacent pairs of the primary and secondary bezel facets 104 and 106 and are separated by rib lines 114. Each upper girdle facets 108 are likewise triangular in shape with the base that is adjacent to the girdle 116. The apex of the triangular upper girdle facet 108 extends in a direction towards the table approximately 60% and is aligned and meets the apex of a corresponding star facet 102, as shown in FIG. 2C. The overall appearance of the gemstone shown in FIG. 2C, formed by the eight pairs of stars 102, with sixteen primary and secondary bezels 104, 106 in between them, forming a visual effect of sixteen larger triangles extending to the girdle from the circular table, and eight pairs of upper girdle facets 108 acting as a border for that picturesque arrangement resulting in an appearance of a shining sun. Both the stars 102 and upper girdle facets 108 angles are determined by their adjacent primary and secondary bezel facets 104 and 106, with the stars 102 being approximately 3 degrees lower and upper girdle facets 108 being approximately 3 degrees higher than their respective bezels 104 and 106, with respect to the angles selected when the blocking steps of the primary and secondary bezels 104, 106 were decided upon.

Referring now to FIG. 2C, sixteen finished star facets 102 and sixteen finished upper girdle facets 108 are shown, which were derived from the areas of the stone indicated by the broken lines in FIG. 2B. The appearance of the finished stone 100 from the top view generally resembles an image of the sun, as the upper girdle facets 108 extend a distance greater than 50% in the direction between the girdle 116 and the table 110, thereby shortening the length of the star facets 102 which surround the table 110. Further, the primary and secondary bezels 104, 106 extend the entire length between the table 110 and the girdle 116, wherein the primary bezels 104 advance further at a steeper angle than their adjacent secondary bezels 106 into the girdle. When the primary bezels and secondary bezels 104,106 are set to a preferred angle close to 34-36 degrees (in accordance with the optical laws of diamonds practice, and popularized by Marcel Tolkowsky), the remaining facet's real estate when brillianteering on the gemstone in this arrangement is pre-determined at a light receivable angle, thus subjecting the crown facets entirety to illumination. In the first embodiment of FIGS. 1A-1E, the crown includes a total of 49 facets, which includes the table 110, eight-primary bezel facets 104, eight-secondary bezel facets 106, sixteen-star facets 102, and sixteen-upper girdle facets 108.

In the following paragraphs other angles in relation to other facets will be discussed. To clarify how these angles are understood, and their relative importance to optically enhancing a diamond prism while sculpting it in a unique arrangement, it is important to understand that the angle of one geometric plane is only realized in relation to another geometric plane. In the case of sculpting diamonds and other gemstones, the set geometric plane is not the tangible girdle 116 shown in FIG. 1C. Rather, the set geometric plane is called the "intangible girdle" (discussed and shown herein as girdle plane) GP, which is a plane that is parallel to the table 110 and extends at a central location through the tangible girdle 116, i.e., the girdle plane GP is the theoretical boundary below the table 110 and through the girdle 116 that separates the crown 101 (FIG. 1A) and bottom (FIG. 1B) portions of the gemstone 100, as illustratively shown in FIG. 1C. By way of illustration, a 35-degree angle which is set for the eight primary bezels 104 is therefore set relative to the girdle plane GP. Similarly, the angles of the other facets on the crown 101 and bottom 103 are also with respect to girdle plane GP referenced from herein. When cutting a gemstone the girdle plane GP is always at the i.e. at the bottom of the hill, relative to how it is held in a DOP (instrument in which a diamond is held for cutting) during the cutting process. A facet on a steeper angle will move faster upwards away from the girdle plane GP, and be cut starting from the girdle 116. While a facet on a lower angle, will move slower down the slope towards the girdle plane GP and be cut starting from the table 110 or culet 124.

Figure 3A:
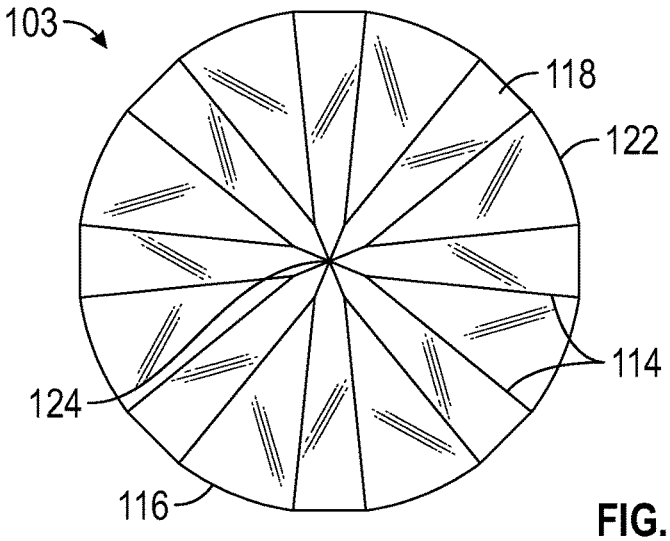
FIGS. 3A-3C depict various top views of cutting stages of a bottom portion of the first embodiment of FIGS. 1A-1E from a round blocked bottom to the finished bottom cut of the gemstone.
Figure 3B:
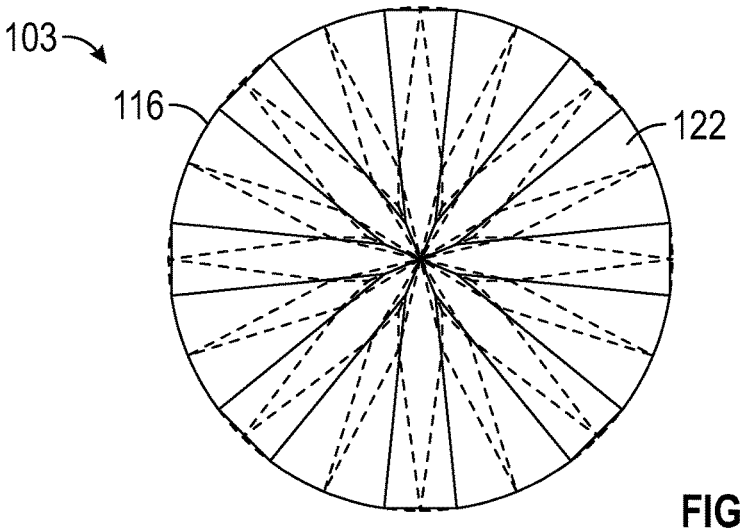
Figure 3C:
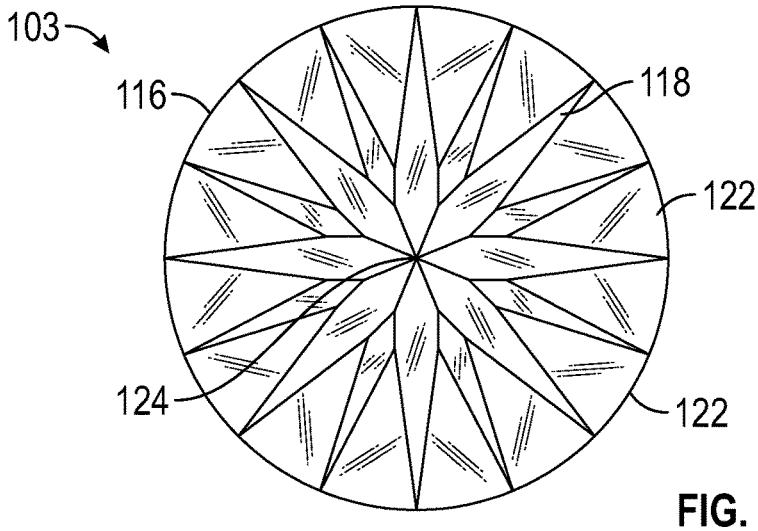

Referring now to FIGS. 3A-3C, the cutting steps of the bottom portion 103 of the gemstone 100 is illustratively shown. In FIG. 3A, the eight primary pavilion facets 118 are cut from the bottom of the round stone such that each pavilion extends from the girdle 116 to the culet 124. The eight primary pavilions 118 are positioned directly between the eight blocked lower girdle facets 122. Preferably, the eight primary pavilions 118 are cut at 41 degrees with respect to the girdle plane GP and are aligned, i.e., cut directly underneath the eight primary bezels 104, such that the points of the eight bezels 104 and primary pavilions 118 meet and are separated only by the girdle 116.

In FIG. 3B, the secondary cutting process of brillianteering the bottom 103 is shown, in which eight pairs of lower girdle facets 122 are cut, as indicated by the broken lines. The point of inception (cutting) of each of the lower girdle facets 122 is on its respective rib line 114 between a primary and secondary pavilion 118 and 120 at the girdle 116. An acute triangular lower girdle facet 122 is formed at that point with the middle point of that triangle advancing from its point (vertices) of inception on the rib line 114 between the two pavilions 118 and 120, up that rib line 114 toward the culet 124, and may reach approximately 70% to the culet. The other 2 points (vertices) of the lower girdle facet 122 advance from their point of inception on the rib line 114 between the two pavilions 118 and 120, at the girdle 116. One vertex advancing to the right on the girdle 116 the other vertex advancing to the left on the girdle 116, each of these 2 points may reach approximately two-thirds (⅔) of the distance from their points of inception to the centers of their respective pavilions at the girdle 116. The cutting the eight secondary pavilions 120, which are the eight narrower facets, reach approximately 80-85% to the culet 124. The secondary pavilions are cut directly between the eight primary pavilions 118. Preferably, the eight secondary pavilions are cut approximately one-degree higher than their respective primaries 118. This procedure of cutting the eight primary and eight secondary pavilions will cause the rib lines 114 of each of the eight secondary pavilions to be thinner than the eight primary pavilions, advancing into the adjacent primary pavilion at its right and left, as well as advancing into the girdle 116 more than the eight primary pavilions 118, as seen in FIG. 1C. The eight secondary pavilions 120 are cut directly underneath the eight secondary bezels 106.

The alternation of primary bezels 104 and secondary pavilions 120, both of which are at steeper angles to the girdle plane GP, create an effect in which eight points of the stone on the top and on the bottom of the total sixteen points of the round stone retain a greater spread, allowing to thin the girdle 116 without causing a liability to the gemstone. This is of interest to the consumer in regards to having a high-performance diamond (enhanced light performance, due to ideal (optimal performance) angles on top and bottom of stone, in an aligned arrangement), with a greater spread (diameter of stone) or "weight ratio" on a finished gemstone. Weight ratio is the relative spread (diameter of stone) of a gemstone, to its ideal arrangement of angles for performance.

With reference to FIG. 3C, a finished bottom 103 of the gemstone 100 is shown. The bottom portion 103 of the gemstone 100 includes eight primary pavilions 118, eight secondary pavilions 120, and eight pairs of lower girdle facets 122 for a total of 32 facets. Accordingly, the first embodiment of the gemstone 100 includes eighty-one (49+32) facets, as compared to the larger facet counts (e.g., 161, 177, 194) of the prior art gemstones discussed above.

Figure 4A:
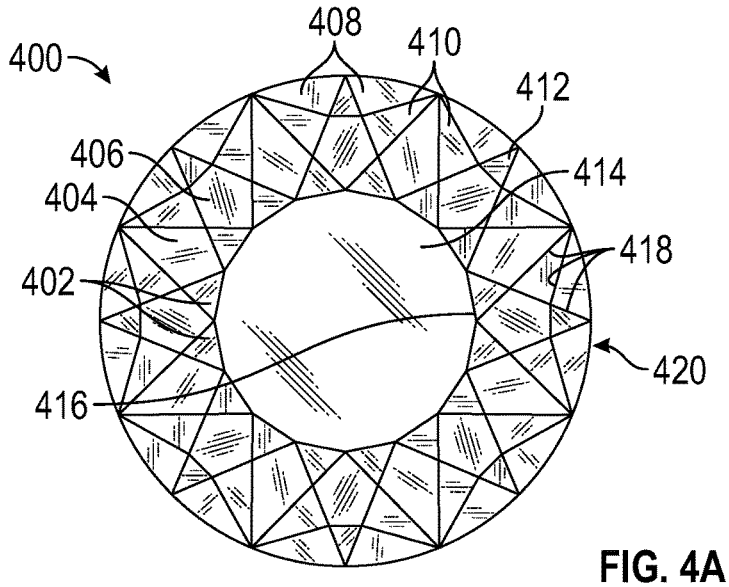
FIGS. 4A-4E depict various views of a second embodiment of a round gemstone cut in accordance with the present invention.
Figure 4B:
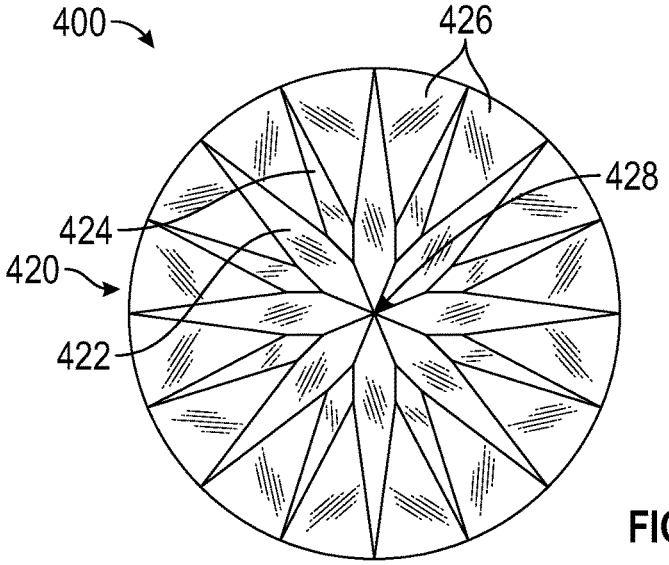

Referring now to FIGS. 4A-4E, a second embodiment of a round eight-count blocked stone 400 is illustratively shown. The facet arrangement of the bottom portion 403 of the stone 400, as shown in FIG. 4B, is identical to the bottom 103 of the first embodiment of the gemstone 100 depicted in FIG. 1B. However, the crown 401 of the second embodiment of the gemstone 300, as shown in FIG. 4A, has additional sets of primary and secondary upper girdle facets 408 and 410, and a bezel extension 412 which keep the shape of the primary bezel 104, while maintaining the image of the sun, and allowing the primary and secondary upper girdle facets 408 and 410 to be on a similar angle, which provide light dispersion adding enhanced color light to the prism.

Figure 4C:
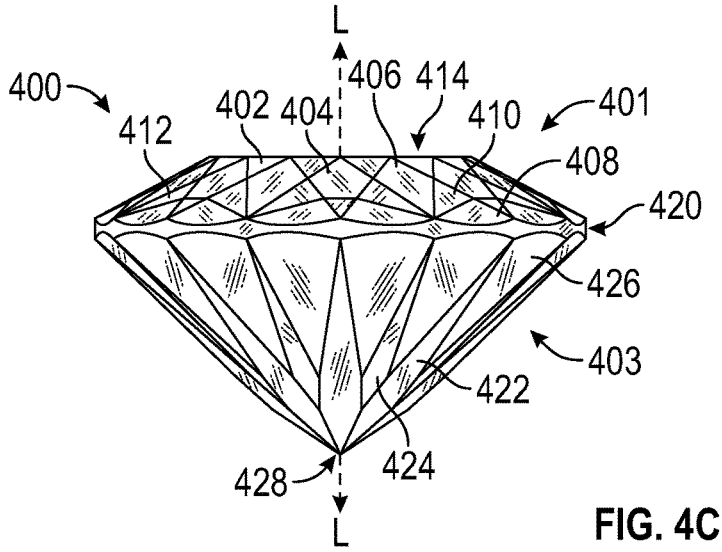
Figure 4D:
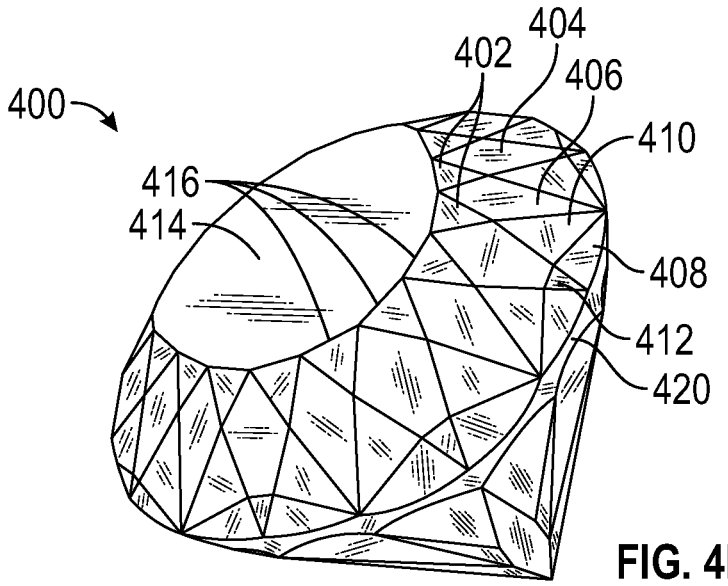
Figure 4E:
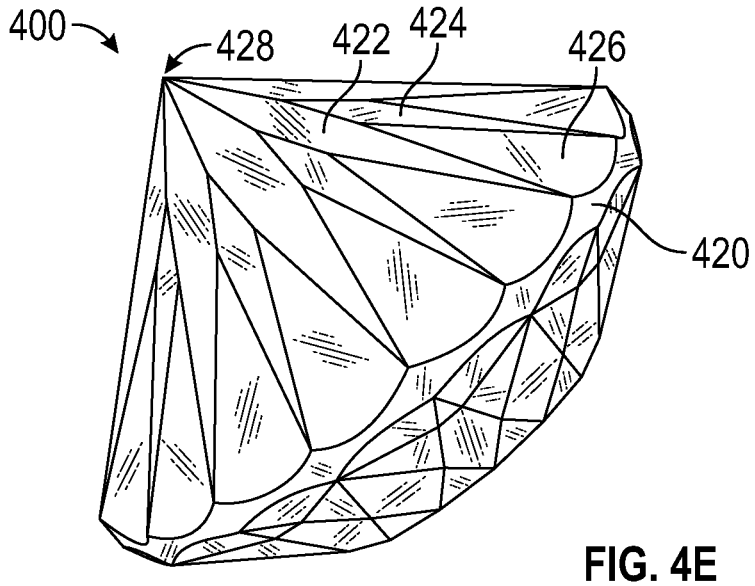

Also shown for sake of better understanding the arrangement of the facets is FIG. 4C, which depicts a side elevation view of the first embodiment of the gemstone 400, and FIGS. 4D and 4E which depict top and bottom perspective views of the first embodiment of the gemstone 400, respectively.

Referring to FIG. 4A, a crown 401 of the second embodiment of gemstone 100 is illustratively shown. The crown 401 illustratively includes sixteen star facets 402 (also referred to as eight pairs of star facets), eight primary bezel facets 404, eight secondary bezel facets 406, sixteen primary upper girdle facets 410 (also referred to as eight pairs of primary upper girdle facets), sixteen secondary upper girdle facets 408 (also referred to as eight pairs of secondary upper girdle facets), eight bezel extensions 412, and one circular table indicated 110, as shown in FIG. 1A. This crown 401, has an additional 24 facets compared to gemstone 100, making the total amount of facets on this second embodiment 105.

Figure 5A:
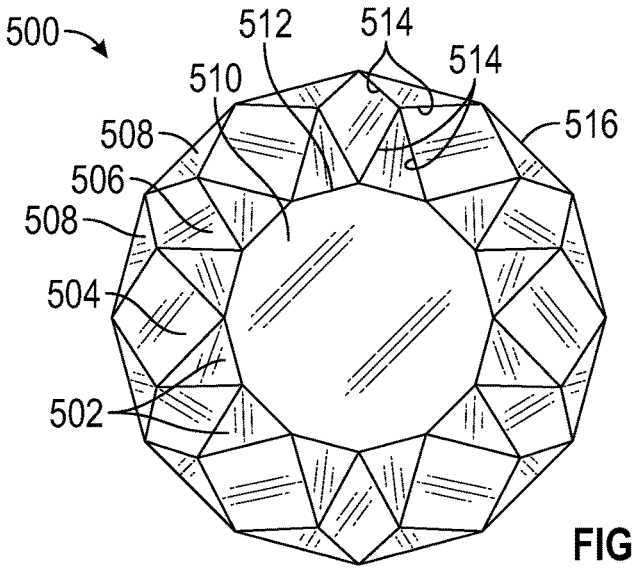
FIGS. 5A-5F depict various views of a third embodiment of a gemstone cut in accordance with the present invention.

FIGS. 5A-7C depicts another embodiment of a gemstone 500 in which the facet formation on the crown 501 gives the general appearance of a flower with pedals extending from the central table 510. FIG. 5A shows a top view of the crown 501 of the gemstone 500 having a table 510, twelve star facets 502 (e.g., six pairs of stars), six primary bezel facets 504, six secondary bezel facets 506, and twelve top break facets 508 (e.g., pair of top breaks). The crown 501 includes twelve table lines 512 at which the bases of the star pairs 502 are formed, and a plurality of rib lines 514 formed between adjacent facets, as discussed above. The girdle 516 is best seen in FIG. 5C.

Figure 5B:
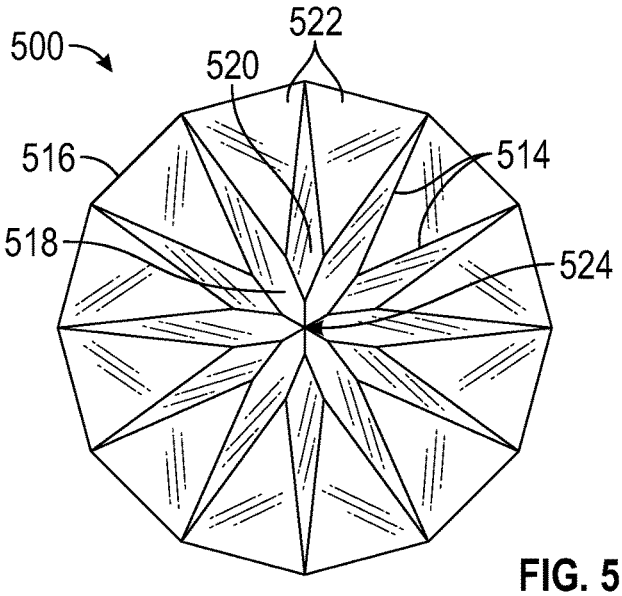

FIG. 5B shows a bottom view of the gemstone 500. The bottom 503 includes six primary pavilions 518, six secondary pavilions 520, twelve lower girdle facets 522 (e.g., referred to as six pairs of lower girdle facets), and a plurality of rib lines 514 formed between adjacent facets. The culet 524 is formed at a point where six primary pavilions 518 meet which is at a central longitudinal axis "L" that extends through the bottom of stone (culet 524) and a center point of the table 510, as illustratively shown in FIG. 5D.

Figure 5C:
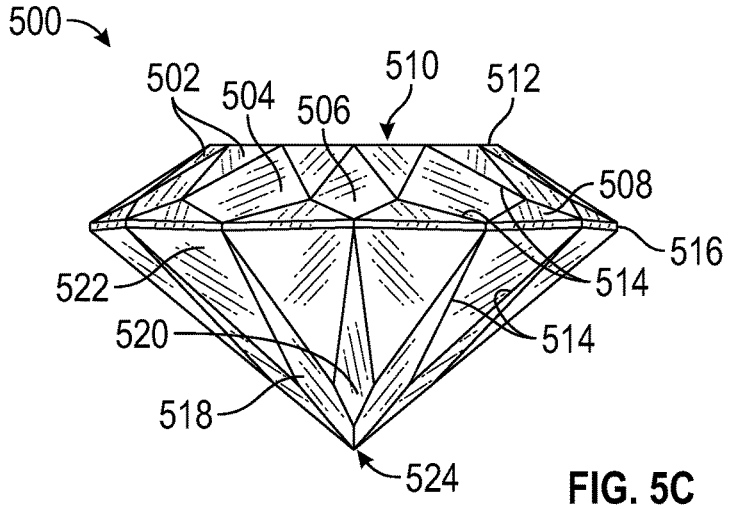
Figure 5D:
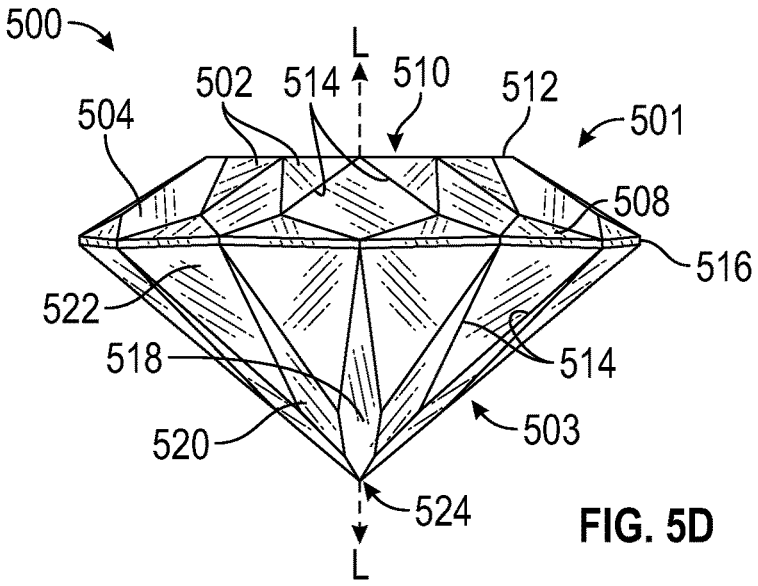
Figure 5E:
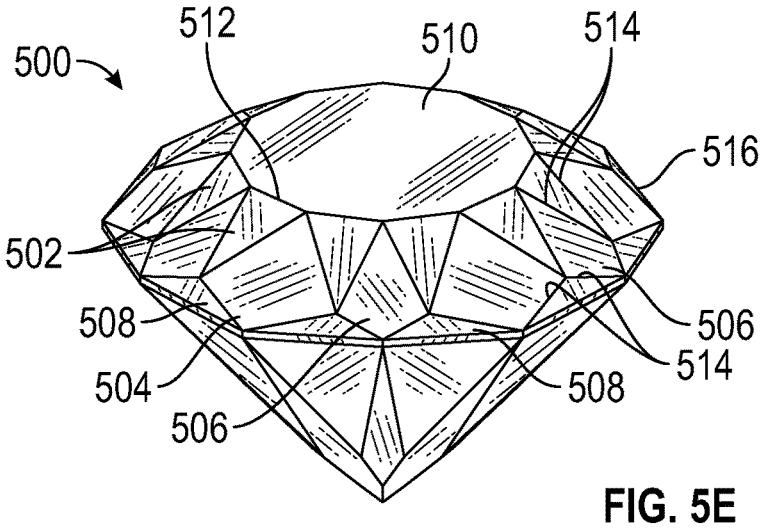
Figure 5F:
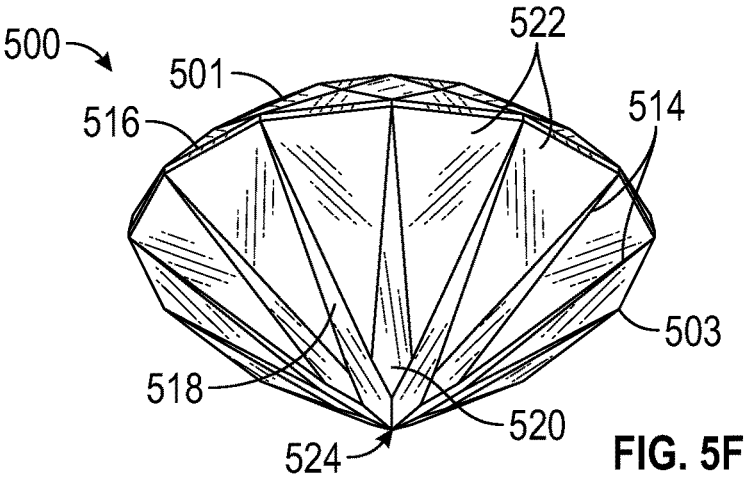

Also shown for sake of better understanding the arrangement of the facets is FIGS. 5C and 5D, which depict front and side elevation views of the gemstone 500, respectively, and FIGS. 5E and 5F which depict top and bottom perspective views of the third embodiment of the gemstone 500, respectively. Referring to FIGS. 5D and 5E, the primary and secondary bezels 504, 506 can be clearly seen extending from the table 510 to the girdle 516. In FIG. 5F, the primary pavilions 518 are clearly shown extending from the girdle 516 down to the culet 524 and the secondary pavilion facets 520 extend downward from the girdle 516 approximately 90% to the culet, and are approximately the same in size as their primary pavilions 518.

Figure 6A:
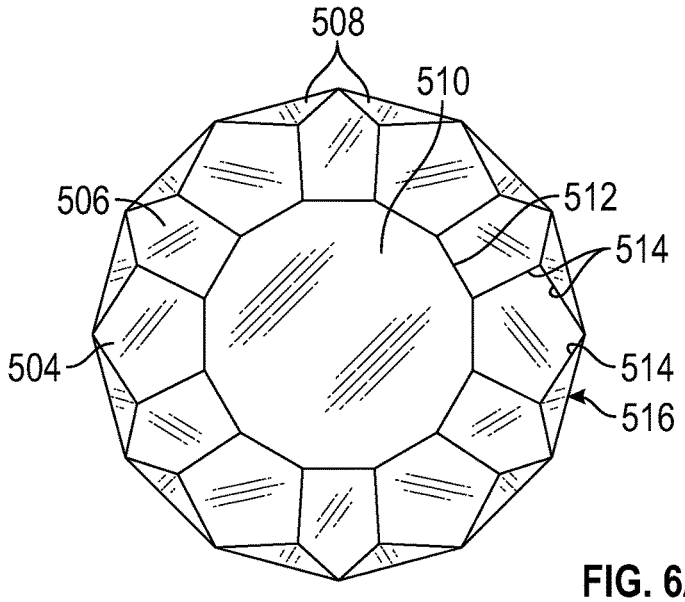
FIGS. 6A-6C depict various top views of cutting stages of the crown portion of the third embodiment of FIGS. 5A-5F from a modified round blocked crown block to the finished crown cut of the gemstone.

Referring now to FIG. 6A, a method of cutting the gemstone 500 is illustratively shown. The first three steps of this invention are shown in completion. In a first step, the twelve-sided shape is formed with twelve girdle facets 516 shown in FIG. 6C. In a second step, the six primary bezels 504 are cut, being the six wider facets surrounding the table 510 in FIG. 6A. These six primary bezels 504 are positioned directly between the twelve girdle facets 516, with the six center points of these primary bezels 504 at the girdle 516 being at six of the twelve points where the girdle facets touch each other. Preferably the six primary bezels 504 in FIG. 6A are cut to an approximate angle of 35 degrees with respect to the girdle plane GP. In a third step, the crown's 501 secondary blocking procedure is performed, as the six secondary bezels 506 are cut, i.e., the six narrower facets surrounding the table 510 as shown in FIG. 6A. The six secondary bezels are positioned directly between the six primary bezels 504, placing the center points of these secondary bezels at the girdle 516 of the remaining six of the twelve points where the girdle facets touch each other. Preferably the six secondary bezels 506 are cut approximately 2½ degrees lower than the six primary bezels 504. Preferably the six secondary bezels advance into the table 510 as far as the six primary bezels, forming six table lines 512 at least as long as the six table lines of the six primary bezels left between. This procedure of cutting the six primary and six secondary bezels 504 and 506 will leave the rib lines 514 of each of the six secondary bezels parallel to each other, and will leave the six secondary bezels less advanced into the girdle 516 than the six primary bezels, due to being on a lower angle seen in FIG. 6A.

Figure 6B:
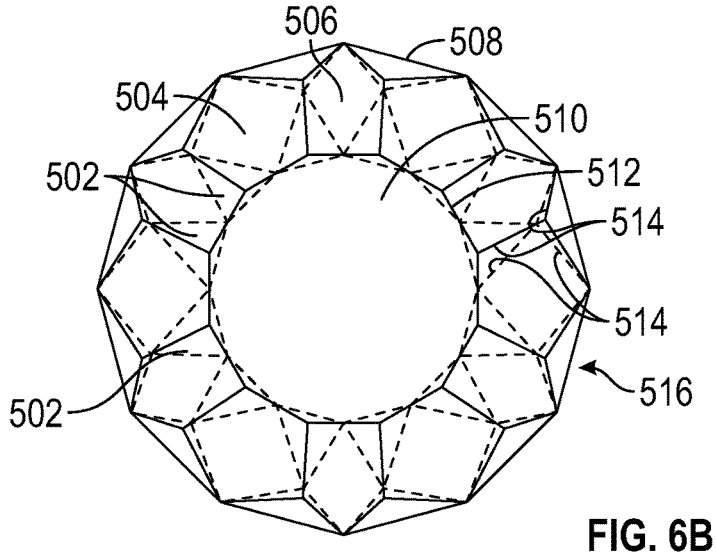

With reference to FIG. 6B, the final steps for brillianteering the crown 501 is shown and discussed. Twelve stars 502 and twelve top breaks 508 which are both indicated by broken lines of FIG. 6B are shown. The inception of each of the twelve stars 502 are indicated by the broken lines reaching from the table 510 approximately 75% to the girdle 516, from each of the twelve points (vertices) where the twenty-four rib lines 514 meet the twelve table lines 512, with the triangular facets last point meeting with the twelve top breaks 508 as seen in FIG. 6A. These twelve stars form twelve triangles between the primary and secondary bezels 504 and 506, each reaching approximately 50% across the table lines on their right and left, and 75% down their respective rib lines, with each star 502 advancing slightly into the table 510 (as indicated by broken lines in FIG. 6A). With the primary bezels 504 set to 35 degrees to the girdle plane GP, and secondary bezels 506 set to 33 degrees, with the table being approximately 57% of the diameter of the stone, making the extended stars pre-determined to be at an angle of approximately 30 degrees, as opposed to the stars of the industry standard round brilliant stone, which are determined at a less light receivable angle of 23 degrees to the girdle plane GP. The combination of an approximate 57% table 510, primary bezels 504 set to 35 degrees, secondary bezels set to 33 degrees, and stars being pre-determined at 30 degrees, allow for the entirety of the crown FIG. 5A of stone to be light receivable, extending light throughout the surface of the crown to its steep edge, thereby enhancing its outer appearance from an aerial view. The remaining broken lines indicate the twelve top breaks 508. The inception of each of these twelve top breaks is formed at the girdle 516, where the twenty-four wavy lines are formed by twelve girdle facets 516, as best seen in FIG. 6A. The twelve top breaks 508 intersect the six primary and secondary bezels 504 and 506, which meet the twelve rib lines 514 formed by the primary and secondary bezels 504 and 506 intersecting. (See FIG. 6A) Each of these twelve top breaks 508 advance to their respective predetermined points, two of those points to the right and left at the center points of the primary and secondary bezels 504 and 506 are pre-determined by their respective girdle facets, and the 3rd points being the point of the star 502 directly above which reaches approximately 75% to the girdle, allowing its respective top break below it to reach 25% to the table, more than doubling in size compared to the prior art gemstone of the '075 patent and those described in the Gems and Gemology 2010 article, while maintaining a steeper angle for better performance. With the angles of the primary and secondary bezels 504 and 506 set to 35 and 33 degrees and with these top breaks 508 reaching 25% towards the table 510, the angles of these top breaks are pre-determined at approximately 55 degrees to the girdle plane GP, which is a non-light receivable angle, and allows these facets to function as direct light-paths (see e.g., 'Gems and Gemology 2010) which sharpen the diamond prism, immensely affecting it's brilliance, as well as creating a scalloped perimeter (claims 1 and 9 of patent '075). These brillianteered twelve stars 502, and twelve top breaks 508 reshape the blocked six wider primary bezels 504, and the six narrower secondary bezels 506 of FIG. 6A, into the final six wider and narrower bezel shapes indicated by the broken lines of FIG. 6B, and shown in FIG. 6C.

Figure 6C:
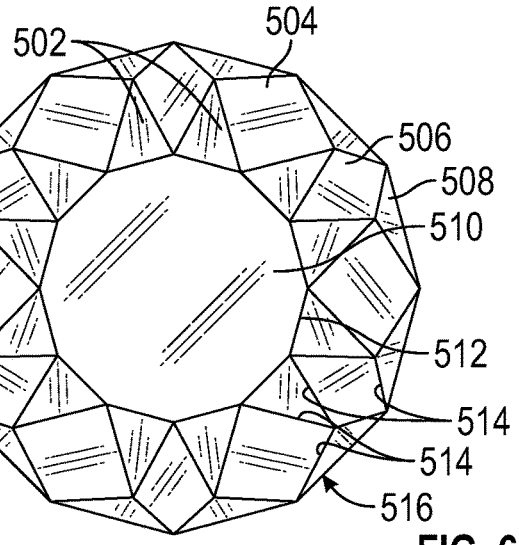

With reference to FIG. 6C, twelve finished stars and twelve finished top breaks, indicated by broken lines of FIG. 6B, and the finished crown 501 of the present invention are shown. With primary and secondary bezels 504 and 506 having an upside-down shape in comparison to the first embodiment gemstone 100, as shown in FIG. 1A. Giving a visual perception from the aerial view of a flower rather than a sun. This is due to the extension of its stars 502 reaching 75% to the girdle rather than 40%.

Figure 7A:
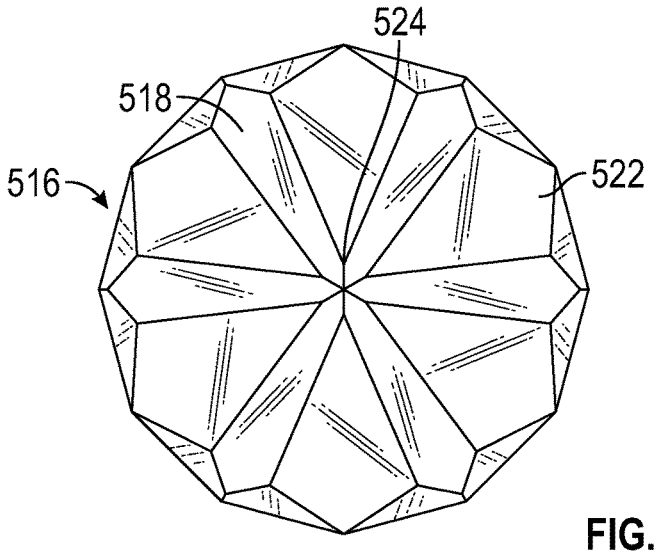
FIGS. 7A-7C depict various top views of cutting stages of a bottom portion of the third embodiment of FIGS. 5A-5F from a modified round blocked bottom to the finished bottom cut of the gemstone.
Figure 7B:
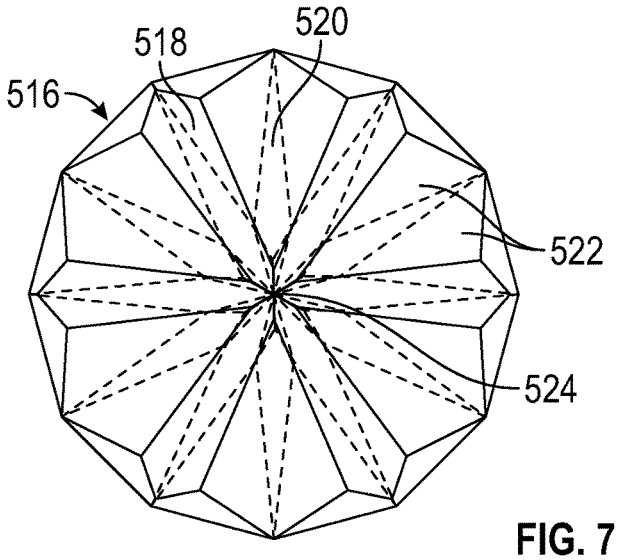
Figure 7C:
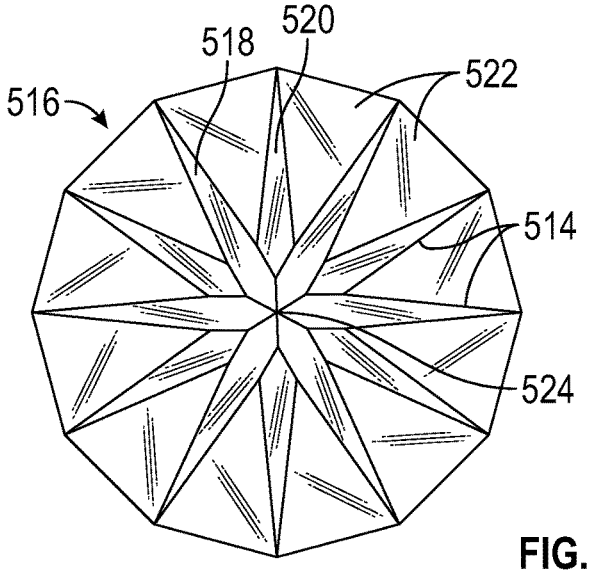

FIGS. 7A-7C illustrate the steps of cutting the bottom 503 of FIG. 5B. In a first step, the six primary pavilions 518 are cut, being the six narrower facets reaching the culet 524 in FIG. 7A. These six primary pavilions 518 are positioned directly between the twelve girdle facets 516 and are adjacent to the six blocked lower girdle facets 522. Preferably these six primary pavilions 518 in FIG. 7A are set at approximately 41 degrees to the girdle plane GP, and are cut directly underneath the six primary bezels 504. In a second step, the secondary blocking procedure on bottom 503 is shown as six secondary pavilions 520 are cut, being the six wider facets reaching approximately 90% to the culet 524 in FIG. 7A. These six secondary pavilions 520 should be cut directly between the six primary pavilions 518, placing the six center points of these secondary pavilions 520 at the girdle 516, being at six of the twelve points where the twelve girdle facets touch each other. Preferably these six secondary pavilions 520 should be cut approximately one-degree higher than their respective primary pavilions. This procedure of cutting the six primary and six secondary pavilions will cause the rib lines 514 of each of the six secondary pavilions to spread wider than the six primary pavilions, advancing into the adjacent primary pavilion at its right and left, as well as advancing into the girdle 516 more than the six primary pavilions 518, as seen in FIG. 7A. These six secondary pavilions 520 are cut directly underneath the six secondary bezels 506. With the six primary bezels 504, and six secondary pavilions 520 advancing further into the girdle 516 at steeper angles than their adjacent facets, this creates an advantage for the spread of a stone in regards to weight ratio. This is of interest to the consumer in regards to having a high-performance diamond (enhanced light performance, due to ideal angles on top and bottom of stone, in an aligned arrangement), with a greater spread (diameter of stone) on a finished gemstone. In order to understand "weight ratio", one has to be able to visualize two cut gemstones of the same shape and size, with their respective similarities, and differences. For example, assume there two stones, with a first stone having primary bezels on 35 degrees, primary pavilions on 41 degrees, and a medium size girdle, and a second stone with primary bezels on 32.5, primary pavilions on 40, with a razor thin girdle, while all the other facets are cut the same on both stones. The stone with higher (steeper) angles (e.g., the first stone) will have a smaller diameter from an aerial (top) view, and the other stone will appear clearly larger in its appearance, due to the lower angle of facets into the girdle using to greater majority of its real estate. However, spread does not equal performance, and a gemstone with ideal angles may not have a great spread. The present embodiment combines the benefits of both by maintaining a greater spread through advancing into the girdle further at six points on top and six alternating points on bottom, squeezing the potential real estate of the girdle, without having it be a liability, while determining preferable angles during the cutting process of facets otherwise not subjected to light return. There is also interest for manufacturers as well in regards to weight ratio, as the yield will be approximately 9% greater than that of a standard round stone from rough crystal (ideal shape octahedron) in accordance with Sarin-Technology used worldwide in diamond cutting production. A basic guideline to saving weight when cutting a piece of rough to a finished polished diamond is to cut with the bottoms (103, 403, 503) the minimal amount into the girdle 516 as possible, thereby leaving as much girdle for the crown 101, 401, 501 as possible, in order to not have to use girdle for the crown later, which loses weight, and pulls in the spread of the stone. The way to follow that guideline is to position the rough so that the bottom FIG. 5B facet arrangement dictates the points where the facets will go into the girdle the least possible. This procedure is referred to in the diamond industry as twisting. The 9% extra yield this invention has potential for generating is in relation to twisting the stone by positioning the secondary pavilions 520 and lower girdle facets 522 accordingly with the rough. In conjunction with FIG. 6B, the lower girdle facets 522 will be discussed in relation to FIG. 7B. These lower girdle facets 522 are cut from the center of the primary bezels 504 and primary pavilions 518, to the centers of the secondary bezels 506, and secondary pavilions 520.

With reference to FIG. 7B; the brillianteering process on bottom 503 is illustratively shown. In particular, twelve lower girdle facets 522 indicated by broken lines are shown. The inception of each of these lower girdle facets is formed at the girdle (516 of FIG. 5B), where the twenty-four wavy lines formed by the twelve girdle facets 516, intersecting the six primary and six secondary bezels 504 and 506, meeting the twelve rib lines 514, formed by the primary and secondary pavilions 518 and 520 intersecting (see FIG. 7A). Each of these lower (flatter) girdle facets advance approximately 70% to the culet 524, and to their remaining 2 predetermined points right and left on the girdle, to the centers of the primary and secondary pavilions, predetermined by their respective girdle facets. With the six primary pavilions on 41 degrees, and six secondary pavilions on 42 degrees, these lower girdle facets are determined at 43 degrees.

With reference to FIG. 7C, twelve finished lower girdle facets 522 indicated by broken lines of FIG. 7B, and the finished bottom FIG. 5B of the present invention are shown.

The present embodiments are improvements over the prior art and '075 patent. In the prior art crowns blocking process for eight-count or six-count for a round or modified round stone, a primary and secondary blocking procedure is done, as shown for the six-count modified round in FIG. 11 of the prior art '075 patent. Conversely, on the crown (101, 401, 501) of the present embodiments, eight or six sections of primary and secondary bezels (104, 106, 404, 406, 504, 506) are formed, in which the secondary bezels maintain their position, and form with the same shape and nearly the same size (relative to blocking count) as the primaries during the brillianteering process. This allows the facets to extend from the table all the way from the table to the girdle, on alternated ideal angles relative to their adjacent primary facets. Through the elimination of primary upper girdle facets 424 and 1312 of '075 patent, this process of simplified brillianteering a secondary blocked gemstone with fully formed secondary bezels on the crown is possible. Also, this simplification allows for the stars (102, 402, 502) of the present embodiments to extend farther through the surface area of the crown, set at a light receivable angle, thereby further illuminating the crown as compared to stars that do not extend as far to the girdle at a non-light receivable angle. The upper girdle facets and top breaks in this invention are one in the same, but are named differently for their difference in function, and are shown to be able to move towards the table a given percentage per the embodiment, in order to achieve its desired effect per the arrangement. In the gemstone 100 of the first embodiment, the upper girdle facets 108 advance farther to the table, shortening the star slightly but maintaining a light receivable angle making all facets on the crown light receivable and allowing illumination of the prism until its edge, showing a much clearer and pronounced round shape, in comparison to the industry standard round. In gemstone 400 of the second embodiment, it follows in the exact same manner, only differing by splitting the upper girdle facets sixteen times and adding a bezel extension 412, which thereby allow the primary and secondary upper girdle facets 408, 410 to be set at an angle to provide light dispersion into the gemstone.

Lastly, for gemstone 500 of the third embodiment, the "upper girdle facets" are called top breaks 508 due to their nature of being on an extremely steep angle in comparison to the other facets on the crown. As the stars 502 of gemstone 500 extend farther towards the girdle, the top breaks are pre-determined at a steep angle, but still more than double in size compared to prior art of the'075 patent and 'Gems and Gemology 2010 article. Advantageously, the increased size and positioning of the top breaks 508 increases direct light path and the scalloping functionality of the facet. Also these top breaks 508 have the longer side of their base of the triangle where the primary bezel 504 point advances into girdle, which when pronged relative to the prior art 'Gems and Gemology 2010 article make the triangles more even but in this invention on the primary bezel, allowing the gemstones crown to be better shown. For the bottom (103, 403, 503) relation in this invention and the improvements made over '075 patent, it is a matter of simplification. Through the removal of extra pavilion splits and facets, the current inventions embodiments follow with the foundation of the top. Building off the primary and secondary blocking foundation, and finishing bottom brillianteering with the same principle, as primary and secondary facets remain the same in shape and nearly the same in size relative to the gemstones blocking count.

The exemplary methods disclosed herein may be implemented in a variety of manners as previously discussed. The embodiment and various aspects of the invention may be implemented using a variety of gemstones and is not limited to diamond. Persons skilled in the art will appreciate that the present invention can be practiced by other than the described examples and embodiments, which are presented for purposes of illustration rather than of limitation and that the present invention is limited only by the claims that follow.

REFERENCE DESIGNATIONS

GP—girdle plane (intangible girdle)
100—first embodiment of gemstone
101—crown
102—stars
103—bottom
104—primary bezel
106—secondary bezel
108—upper girdle facet
110—table
112—table-line
114—rib lines
116—girdle
118—primary pavilion
120—secondary pavilion
122—lower girdle facets
124—culet
400—second embodiment of gemstone

401—crown
402—table
403—bottom
404—stars
406—secondary bezel
408—secondary upper girdle facet
410—primary upper girdle facet
412—bezel extension
414—table
416—table line
420—girdle
422—primary pavilion
424—secondary pavilion
426—lower girdle facets
428—culet
500—third embodiment of gemstone
501—crown
502—stars
503—bottom
504—primary bezels
506—secondary bezels
508—top breaks
510—table
512—table-line
514—rib lines
516—girdle
518—primary pavilion
520—secondary pavilion
522—lower girdle facets
524—culet

What is claimed is:

1. A round cut gemstone comprising:

a crown and a bottom separated by a girdle, the crown including a table surrounded by six primary kite-shaped bezel facets and six secondary kite-shaped bezel facets, each one of the six secondary kite-shaped bezel facets alternating between an adjacent two of the six primary kite-shaped bezel facets, the six primary and six secondary kite-shaped bezel facets extending downwardly from the table to the girdle, wherein the six primary kite-shaped bezel facets are arranged to advance from the table into the girdle a distance greater than the six secondary kite-shaped bezel facets, the six primary kite-shaped bezel facets being cut higher than the six secondary kite-shaped bezel facets with respect to a girdle plane;

six pairs of triangular-shaped stars, wherein the six pairs of triangular-shaped stars extend downward from the table towards the girdle a predetermined distance between the table and the girdle, and each individual one of the six pairs of triangular-shaped stars being positioned between a primary kite-shaped bezel facet and a secondary kite-shaped bezel facet of the six primary and secondary kite-shaped bezel facets;

six pairs of top breaks which extend a predetermined distance from the girdle towards the table, and each individual one of the six pairs of top breaks being positioned between a one of the six primary kite-shaped bezel facets and an adjacent one of the six secondary kite-shaped bezel facets; and wherein the bottom includes a plurality of bottom facets extending from the girdle to a culet of the gemstone.

2. The gemstone of claim 1, wherein the six pairs of triangular-shaped stars are three degrees lower than an adjacent one of the six primary kite-shaped bezel facets.

3. The gemstone of claim 1, wherein the six pairs of top breaks are cut at a steeper angle than the six primary kite-shaped bezel facets, the six secondary kite-shaped bezel facets and the six pairs of triangular-shaped stars on the crown, such that upon the crown being illuminated the six pairs of top breaks increase a direct light path through the bottom and induce a scalloping effect around a perimeter of the girdle.

4. The gemstone of claim 1, wherein the six secondary kite-shaped bezel facets are at different angles than the six primary kite-shaped bezel facets.

5. The gemstone of claim 4, wherein each of the plurality of bottom facets is angled from each other 15 degrees from an adjacent facet in a 360-degree radius of its modified round shape.

6. The gemstone of claim 1, wherein the bottom comprises a plurality of bottom facets including six primary pavilion facets extending from the girdle to the culet; the bottom further including six secondary pavilion facets interleaved adjacent to the six primary pavilion facets.

7. The gemstone of claim 6, wherein the six primary kite-shaped bezel facets of the crown and the six secondary pavilion facets of the bottom are arranged to advance further into the girdle at steeper angles than the six secondary kite-shaped bezel facets and the six primary pavilion facets, thereby retaining greater spread for the gemstone at alternating points.

8. The gemstone of claim 6, wherein the six primary pavilion facets extend a greater distance from the girdle towards the culet than the six secondary pavilion facets.

9. The gemstone of claim 6, wherein the six secondary pavilion facets extend deeper into the girdle than the six primary pavilion facets.

10. The gemstone of claim 6, wherein the six secondary pavilion facets are at different angles than the six primary pavilion facets.

11. The gemstone of claim 6, wherein the six primary kite-shaped bezel facets are aligned over the six primary pavilion facets and the six secondary kite-shaped bezel facets are aligned over the six secondary pavilion facets.

12. The gemstone of claim 6 further comprising six pairs of lower girdle facets extending from the girdle towards the culet a predetermined distance, and each individual one of the six pairs of lower girdle facets being positioned between a primary pavilion facet and a secondary pavilion facet of the six primary and secondary pavilion facets.

13. The gemstone of claim 12, wherein the six pairs of top breaks are aligned over the six pairs of lower girdle facets.

14. A round cut gemstone comprising:

a crown and a bottom separated by a girdle, the crown including a table which is surrounded by a plurality of triangular-shaped stars forming respective table lines, a plurality of primary bezel facets and a plurality of secondary bezel facets which extend downwardly from the table to the girdle, wherein each one of the plurality of secondary bezel facets is positioned between a pair of primary bezel facets of the plurality of primary bezel facets, wherein the plurality of primary bezel facets advance from the table into the girdle a distance greater than the plurality of secondary bezel facets, and the plurality of primary bezel facets are cut at a higher angle than the plurality of secondary bezel facets with respect to a girdle plane of the gemstone;

wherein the plurality of triangular-shaped stars extend downward a predetermined distance from the table towards the girdle, each one of the plurality of triangular-shaped stars being positioned between a primary bezel facet and an adjacent secondary bezel facet of the plurality of primary and secondary bezel facets; and a plurality of top breaks which advance a predetermined distance from the girdle towards the table, each of the plurality of top breaks being positioned between a one of the plurality of primary bezel facets and an adjacent one of the plurality of secondary bezel facets.

15. The gemstone of claim 14, wherein the plurality of top breaks are triangular shaped and cut at a steeper angle than the plurality of primary bezel facets, the plurality of secondary bezel facets and the plurality of triangular-shaped stars on the crown, such that upon the crown being illuminated the plurality of top breaks increase a direct light path through the bottom and induce a scalloping effect around a perimeter of the girdle.

16. The gemstone of claim 14, wherein the plurality of primary bezel facets are at different angles than the plurality of secondary bezel facets.

17. The gemstone of claim 14, wherein a total quantity of the plurality of triangular-shaped stars is equal to a combined quantity of the plurality of primary bezel facets and the plurality of secondary bezel facets; and wherein a total quantity of the plurality of top breaks is equal to a total quantity of the plurality of triangular-shaped stars.

18. The gemstone of claim 14, wherein the plurality of primary bezel facets equals eight primary bezel facets, and the plurality of secondary bezel facets equals eight secondary bezel facets.

19. The gemstone of claim 14, wherein the plurality of primary bezel facets equals six primary bezel facets, and the plurality of secondary bezel facets equals six secondary bezel facets.

20. The gemstone of claim 14, wherein the bottom includes a plurality of primary pavilion facets and a plurality of secondary pavilion facets, the plurality of primary pavilion facets extending from the girdle to a culet, the plurality of secondary pavilion facets advancing from the girdle and towards the culet a distance less than the plurality of primary pavilion facets; each one of the plurality of secondary pavilion facets being interleaved between an adjacent one pair of the plurality of primary pavilion facets.

21. The gemstone of claim 20, wherein the plurality of primary bezel facets are at different angles than the plurality of secondary bezel facets.

22. The gemstone of claim 20, wherein each of the plurality of secondary pavilion facets extends deeper into the girdle than each of the plurality of primary pavilion facets.

23. The gemstone of claim 20, wherein the plurality of primary pavilion facets are at different angles than the plurality of secondary pavilion facets.

24. The gemstone of claim 20, wherein the plurality of primary bezel facets on the crown and the plurality of secondary pavilion facets on the bottom are arranged to advance further into the girdle at steeper angles than the plurality of secondary bezel facets and the plurality of primary pavilion facets such that the girdle is wavy, thereby retaining greater spread for the gemstone at alternating points.

25. The gemstone of claim 20, wherein the plurality of primary bezel facets are aligned over the plurality of primary pavilion facets and the plurality of secondary bezel facets are aligned over the plurality of secondary pavilion facets.

26. The gemstone of claim 20 further comprising a plurality of pairs of lower girdle facets which extend from the girdle towards the culet a predetermined distance, and each individual one of the plurality of pairs of lower girdle facets being positioned between a primary pavilion facet and a secondary pavilion facet of the plurality of primary and secondary pavilion facets.

27. The gemstone of claim 26, wherein the plurality of pairs of top breaks are aligned over the plurality of pairs of lower girdle facets.

* * * * *